US008424453B2

(12) United States Patent
DeMoore

(10) Patent No.: US 8,424,453 B2
(45) Date of Patent: Apr. 23, 2013

(54) APPARATUS AND METHOD FOR ADJUSTING ANTI-MARKING JACKETS

(75) Inventor: Howard W. DeMoore, Dallas, TX (US)

(73) Assignee: Printing Research, Inc., Dallas, TX (US)

( * ) Notice: Subject to any disclaimer, the term of this patent is extended or adjusted under 35 U.S.C. 154(b) by 237 days.

(21) Appl. No.: 12/874,154

(22) Filed: Sep. 1, 2010

(65) Prior Publication Data

US 2012/0048134 A1 Mar. 1, 2012

(51) Int. Cl.

| | |
|---|---|
| ***B41F 7/02*** | (2006.01) |
| ***B41F 30/04*** | (2006.01) |
| ***B41N 3/00*** | (2006.01) |

(52) U.S. Cl.

USPC ..... 101/217; 101/416.1; 101/379; 101/401

(58) Field of Classification Search ..... 101/401.1, 101/416.1, 422, 415.1, 419, 493, 232, 483, 101/492, 401, 379, 217; 242/571, 572; *B41F 22/00, B41F 23/00, 21/00, 30/04; B41N 3/00*

See application file for complete search history.

(56) References Cited

U.S. PATENT DOCUMENTS

| | | | | |
|---|---|---|---|---|
| 3,533,355 | A | 10/1970 | Wall | |
| 3,791,644 | A | 2/1974 | DeMoore | |
| 3,835,778 | A | 9/1974 | Bock | |
| 3,960,081 | A | 6/1976 | Gustavs et al. | |
| 4,133,264 | A * | 1/1979 | Fermi et al. | 101/415.1 |
| 4,301,878 | A * | 11/1981 | Soe | 177/5 |
| 4,402,267 | A | 9/1983 | DeMoore | |
| 4,552,631 | A | 11/1985 | Bissot et al. | |
| 4,724,762 | A * | 2/1988 | Jeschke et al. | 101/415.1 |
| 4,761,324 | A | 8/1988 | Rautenberg et al. | |
| 4,860,650 | A | 8/1989 | Houser | |
| 5,046,421 | A | 9/1991 | DeMoore | |
| 5,065,122 | A | 11/1991 | Juskey et al. | |
| 5,323,702 | A | 6/1994 | Vrotacoe et al. | |
| 5,384,019 | A | 1/1995 | Keating et al. | |
| 5,396,841 | A | 3/1995 | Güls | |

(Continued)

FOREIGN PATENT DOCUMENTS

EP 1332873 B1 12/2005

OTHER PUBLICATIONS

Notice of Allowance dated Mar. 23, 2012, U.S. Appl. No. 12/343,484, filed Dec. 24, 2008.

(Continued)

*Primary Examiner* — Daniel J Colilla
*Assistant Examiner* — John M Royston

(57) ABSTRACT

In a printing press a method is provided. The method comprises coupling an adjustment tool to a transfer cylinder substantially parallel to an axis of the transfer cylinder and coupling a first end of a flexible jacket to a first attachment structure coupled to the transfer cylinder, wherein the first attachment structure is proximate to a first edge of the transfer cylinder. The method further comprises placing the jacket around the transfer cylinder and over the adjustment tool and coupling the second end of the jacket to a second attachment structure coupled to the transfer cylinder, wherein the second attachment structure is proximate to a second edge of the transfer cylinder and the jacket is attached without free play to the transfer cylinder. The method further comprises withdrawing the adjustment tool from between the transfer cylinder and the jacket, whereby an amount of free play of the flexible jacket remains.

20 Claims, 10 Drawing Sheets

U.S. PATENT DOCUMENTS

| | | | | |
|---|---|---|---|---|
| 5,511,480 | A | 4/1996 | DeMoore et al. | |
| 5,549,966 | A | 8/1996 | Sassa | |
| 5,603,264 | A | 2/1997 | DeMoore et al. | |
| 5,635,124 | A | 6/1997 | Abrams et al. | |
| 5,667,611 | A | 9/1997 | Sassa | |
| 5,768,990 | A | 6/1998 | Vrotacoe et al. | |
| 5,785,105 | A | 7/1998 | Crider et al. | |
| 5,842,412 | A | 12/1998 | Greenway et al. | |
| 5,842,419 | A | 12/1998 | Puschnerat | |
| 5,907,998 | A | 6/1999 | DeMoore et al. | |
| 5,957,421 | A * | 9/1999 | Barbour | 248/220.21 |
| 5,979,322 | A | 11/1999 | DeMoore et al. | |
| 6,073,556 | A | 6/2000 | DeMoore et al. | |
| 6,119,597 | A | 9/2000 | DeMoore et al. | |
| 6,192,800 | B1 | 2/2001 | DeMoore et al. | |
| 6,244,178 | B1 | 6/2001 | DeMoore et al. | |
| 6,393,249 | B1 | 5/2002 | Aslam et al. | |
| 6,647,237 | B2 | 11/2003 | Schlueter, Jr. et al. | |
| 6,901,859 | B2 | 6/2005 | Yokoyama | |
| 7,021,210 | B2 | 4/2006 | Elliott et al. | |
| RE39,305 | E | 9/2006 | DeMoore et al. | |
| 7,270,873 | B2 | 9/2007 | Rizika et al. | |
| 7,403,594 | B2 | 7/2008 | Endo et al. | |
| 7,438,115 | B2 | 10/2008 | Bohlen | |
| 7,478,592 | B2 | 1/2009 | Zahnd et al. | |
| 7,593,234 | B2 | 9/2009 | Okuda | |
| 8,146,497 | B2 | 4/2012 | Caliari | |
| 8,220,338 | B2 | 7/2012 | Tojo | |
| 8,220,388 | B2 | 7/2012 | DeMoore et al. | |
| 8,281,716 | B2 | 10/2012 | DeMoore et al. | |
| 2001/0042469 | A1 | 11/2001 | Vosseler | |
| 2002/0155289 | A1 | 10/2002 | Cistone et al. | |
| 2003/0113466 | A1 | 6/2003 | Frazzitta et al. | |
| 2003/0226461 | A1 | 12/2003 | Miller | |
| 2004/0219358 | A1 | 11/2004 | Tokarsky et al. | |
| 2004/0259033 | A1 | 12/2004 | Kunita | |
| 2005/0212878 | A1 | 9/2005 | Studer et al. | |
| 2006/0249041 | A1 | 11/2006 | DeMoore et al. | |
| 2007/0202442 | A1 | 8/2007 | Zwadlo | |
| 2007/0207186 | A1 | 9/2007 | Scanlon et al. | |
| 2007/0261579 | A1 | 11/2007 | Rizika | |
| 2008/0026201 | A1 | 1/2008 | Rizika et al. | |
| 2008/0106001 | A1 | 5/2008 | Slafer | |
| 2010/0101441 | A1 | 4/2010 | DeMoore et al. | |
| 2010/0154665 | A1 * | 6/2010 | DeMoore et al. | 101/217 |
| 2010/0154667 | A1 | 6/2010 | DeMoore et al. | |
| 2010/0307357 | A1 | 12/2010 | DeMoore | |
| 2012/0073463 | A1 | 3/2012 | DeMoore | |
| 2012/0152138 | A1 | 6/2012 | DeMoore et al. | |
| 2012/0192739 | A1 | 8/2012 | DeMoore et al. | |
| 2012/0192743 | A1 | 8/2012 | DeMoore et al. | |
| 2012/0325100 | A1 | 12/2012 | DeMoore et al. | |

OTHER PUBLICATIONS

DeMoore, Howard, et al., Patent Application entitled "Hook to Fabric Fastener Closure Tool," filed Feb. 29, 2012, U.S. Appl. No. 13/408,887.

Foreign Communication From a Related Counterpart Application—International Search Report and Written Opinion, PCT/US2009/068311, Mar. 11, 2010.

Foreign Communication From a Related Counterpart Application—International Preliminary Report on Patentability, PCT/US2009/068311, Jul. 7, 2011.

Foreign Communication From a Related Counterpart Application—International Search Report and Written Opinion, PCT/US2009/061527, Dec. 22, 2009.

Foreign Communication From a Related Counterpart Application—International Preliminary Report on Patentability, PCT/US2009/061527, May 5, 2011.

Office Action Restriction dated Oct. 18, 2011, U.S. Appl. No. 12/343,481, filed Dec. 24, 2008.

Office Action Restriction dated Nov. 4, 2011, U.S. Appl. No. 12/343,484, filed Dec. 24, 2008.

Office Action Restriction dated Sep. 14, 2011, U.S. Appl. No. 12/258,225, filed Oct. 24, 2008.

DeMoore, Howard, et al., Patent Application entitled "Reversible Anti-marking Jackets and Methods of Using," filed Sep. 2, 2011, U.S. Appl. No. 13/224,394.

DeMoore, Howard, Patent Application entitled "Hook to Fabric Fastener Closure Tool," filed Sep. 24, 2010, U.S. Appl. No. 12/890,393.

DeMoore, Howard, et al., Patent Application entitled "Double-sided Anti-marking Jackets Comprised of Beads and Methods of Using in Offset Printing," filed Jan. 31, 2011, U.S. Appl. No. 13/018,107.

Office Action dated Dec. 14, 2011, U.S. Appl. No. 12/343,481, filed Dec. 24, 2008.

Office Action dated Dec. 13, 2011, U.S. Appl. No. 12/343,484, filed Dec. 24, 2008.

Office Action dated Dec. 27, 2011, U.S. Appl. No. 12/258,225, filed Oct. 24, 2008.

Final Office Action dated May 16, 2012, U.S. Appl. No. 12/343,481, filed Dec. 24, 2008.

Supplemental Notice of Allowance dated Apr. 11, 2012, U.S. Appl. No. 12/343,484, filed Dec. 24, 2008.

Foreign Communication From a Related Counterpart Application—International Search Report and Written Opinion, PCT/US2012/023204, May 10, 2012.

Notice of Allowance dated Jul. 18, 2012, U.S. Appl. No. 12/343,481, filed Dec. 24, 2008.

Office Action Restriction dated Aug. 21, 2012, U.S. Appl. No. 12/832,803, filed Jul. 8, 2010.

DeMoore, Howard W., et al., Patent Application entitled, "Anti-marking Jackets Comprised of Fluoropolymer and Methods of Using in Offset Printing," filed Sep. 4, 2012, U.S. Appl. No. 13/603,413.

DeMoore, Howard, et al., Patent Application entitled "Anti-marking jackets Comprised of Fluoropolymer and Methods of Using in Offset Printing," filed Oct. 5, 2012, U.S. Appl. No. 13/646,657.

Office Action dated Nov. 8, 2012, U.S. Appl. No. 12/832,803, filed Jul. 8, 2010.

Notice of Allowance dated Nov. 2, 2012, U.S. Appl. No. 13/603,413, filed Sep. 4, 2012.

* cited by examiner

APPARATUS AND METHOD FOR ADJUSTING ANTI-MARKING JACKETS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the operation of a rotary offset printing press, freshly printed substrates, such as sheets or web material, are guided by transfer cylinders or the like from one printing unit to another, and then they are delivered to a sheet stacker or to a sheet folder/cutter unit, respectively. As used herein, the term "transfer cylinder" includes delivery cylinders, transfer rollers, support rollers, support cylinders, delivery wheels, skeleton wheels, segmented wheels, transfer drums, support drums, spider wheels, support wheels, guide wheels, guide rollers, and the like.

The ink marking problems inherent in transferring freshly printed substrates have been longstanding. In order to minimize the contact area between the transfer means and the freshly printed substrate, conventional support wheels have been modified in the form of relatively thin disks having a toothed or serrated circumference, referred to as skeleton wheels. However, those thin disc transfer means have not overcome the problems of smearing and marking the freshly printed substrate due to moving contact between the freshly printed substrate and the projections or serrations. Moreover, the attempts to cover the transfer cylinder with a cover material and/or minimize the surface support area in contact with the freshly printed substrate material often resulted in further problems.

Various efforts have been made to overcome the limitations of thin disk skeleton wheels. One of the most important improvements has been completely contrary to the concept of minimizing the surface area of contact. That improvement is disclosed and claimed in U.S. Pat. No. 3,791,644 to Howard W. DeMoore, incorporated by reference herein in its entirety, wherein the support surface of a transfer cylinder in the form of a wide wheel or cylinder is coated with an improved ink repellent surface formed by a layer of polytetrafluoroethylene (PTFE).

During the use of the PTFE coated transfer cylinders in high-speed commercial printing presses, the surface of the coated cylinders must be washed frequently with a solvent to remove any ink accumulation. Moreover, it has also been determined that the PTFE coated cylinders do not provide a cushioning effect and relative movement, which are beneficial.

The limitations on the use of the PTFE coated transfer cylinders have been overcome with an improved transfer cylinder having an ink repellent, cushioning, and supportive fabric covering or the like for transferring the freshly printed substrate. It is now well recognized and accepted in the printing industry world-wide that marking and smearing of freshly printed substrates caused by engagement of the wet printed surface with the supporting surface of a conventional press transfer cylinder is substantially reduced by using the anti-marking fabric covering system as disclosed and claimed in U.S. Pat. No. 4,402,267 entitled "Method and Apparatus for Handling Printed Sheet Material," to Howard W. DeMoore, the disclosure of which is incorporated herein by reference.

That system, which is marketed under license by Printing Research, Inc. of Dallas, Tex., U.S.A. under the registered trademark SUPER BLUE® includes the use of a low friction coating or coated material on the supporting surface of the transfer cylinder, and over which is loosely attached a movable fabric covering. The fabric covering provided a yieldable, cushioning support for the freshly printed side of the substrate such that relative movement between the freshly printed substrate and the transfer cylinder surface would take place between the fabric covering and the support surface of the transfer cylinder so that marking and smearing of the freshly printed surface was substantially reduced. Various improvements have been made to the SUPER BLUE® system, which are described in more detail in U.S. Pat. Nos. 5,907,998 and 6,244,178 each entitled "Anti-Static, Anti-Smearing Pre-Stretched and Pressed Flat, Precision-Cut Striped Flexible Coverings for Transfer Cylinders"; U.S. Pat. Nos. 5,511,480, 5,603,264, 6,073,556, 6,119,597, and 6,192,800 each entitled "Method and Apparatus for Handling Printed Sheet Material"; U.S. Pat. No. 5,979,322 entitled "Environmentally Safe, Ink Repellent, Anti-Marking Flexible Jacket Covering Having Alignment Stripes, Centering Marks and Pre-Fabricated Reinforcement Strips for Attachment onto Transfer Cylinders in a Printing Press"; U.S. Pat. No. RE39,305 entitled "Anti-static, Anti-smearing Pre-stretched and Pressed Flat, Precision-cut Striped Flexible Coverings for Transfer Cylinders"; U.S. patent application Ser. No. 12/343,481 entitled "Anti-marking Jackets Comprised of Fluoropolymer and Methods of Using in Offset Printing," by Howard W DeMoore, et al., filed Dec. 24, 2008; and U.S. patent application Ser. No. 12/832,803 entitled "Anti-marking Jackets Comprised of Attachment Structure and Methods of Using in Offset Printing," by Howard W. DeMoore, filed Jul. 8, 2010, each of which is hereby incorporated by reference herein in its entirety. The above cited patents and patent applications are all owned by Printing Research, Inc. of Dallas, Tex., U.S.A.

SUMMARY

In an embodiment, a method of preparing a printing press for printing, wherein the printing press has a transfer cylinder for transferring a freshly printed substrate, is disclosed. The method comprises coupling an adjustment tool to the transfer cylinder substantially parallel to an axis of the transfer cylinder, coupling a first end of a flexible jacket to a first attachment structure coupled to the transfer cylinder, wherein the first attachment structure is proximate to a first axial edge of the transfer cylinder, and placing the flexible jacket around the transfer cylinder and over the adjustment tool. The method further comprises coupling the second end of the flexible jacket to a second attachment structure coupled to the transfer cylinder, wherein the second attachment structure is proximate to a second axial edge of the transfer cylinder and the flexible jacket is attached without free play to the transfer cylinder, and withdrawing the adjustment tool from between the transfer cylinder and the flexible jacket, whereby an amount of free play of the flexible jacket remains.

In an embodiment, a kit for preparing a transfer cylinder of a printing press for printing, the transfer cylinder for transferring a freshly printed substrate, is disclosed. The kit comprises a plurality of flexible jackets, wherein each flexible jacket has a gripper edge and a tail edge and provides an anti-marking surface for transferring printed substrates when installed over the transfer cylinder. The kit further comprises a first adjustment tool, wherein the first adjustment tool is at least as long as one of a width of the gripper edge of the flexible jackets or a width of the tail edge of the flexible jackets, wherein the first adjustment tool has a predetermined thickness effective to adjust the free play of each flexible jacket when installed over the transfer cylinder, and wherein the first adjustment tool has a predetermined flexibility, the predetermined flexibility effective to allow the withdrawal of the first adjustment tool from between the transfer cylinder and one of the flexible jackets when installed over the transfer cylinder and to allow clearance with reference to printing press equipment.

In an embodiment, a method of coupling a flexible jacket to a base cover prior to attaching to a transfer cylinder of a printing press is disclosed. The method comprises laying out the base cover on a surface, the base cover having a first attachment structure coupled to a first end of the base cover and a second attachment structure coupled to a second end of the base cover, placing an adjustment tool on the base cover, and coupling a first end of the flexible jacket to the first attachment structure. The method further comprises positioning the flexible jacket over the adjustment tool, wherein the adjustment tool is positioned between the base cover and the flexible jacket, coupling a second end of the flexible jacket to the second attachment structure, wherein the flexible jacket is attached without free play to the base cover, and withdrawing the adjustment tool from between the base cover and the flexible jacket.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
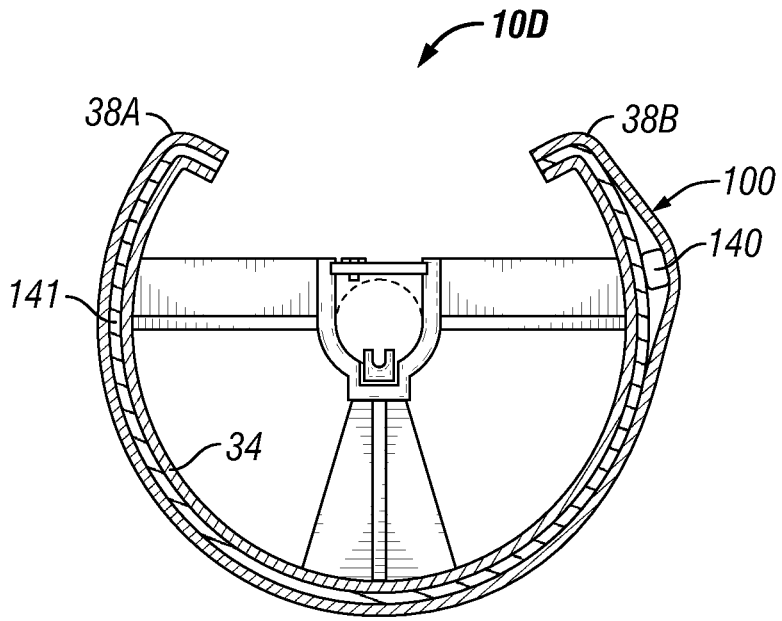
FIG. 1A is a section view of a transfer cylinder, an adjustment tool, and a flexible jacket according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

In an embodiment, a transfer cylinder of a printing press may be at least partially enclosed by a flexible jacket that is installed over the transfer cylinder with an effective amount of free play or end play for promoting anti-marking operation of the printing press. In some contexts, the flexible jacket may be referred to as a net or as an anti-marking jacket. The term flexible jacket may be made of a wide variety of materials. In some embodiments, a cylinder base cover, hereinafter referred to as a base cover, may be installed over the transfer cylinder, for example a low friction base cover, and the flexible jacket may be installed on the transfer cylinder over the base cover. In other embodiments, however, a base cover may be omitted and the flexible jacket may be installed over the transfer cylinder with no intervening base cover. In an embodiment, a plurality of flexible jackets may be installed over the transfer cylinder with no intervening base cover, the plurality of flexible jackets being installed with an amount of free play that is effective to promote anti-marking operation of the printing press. The plurality of flexible jackets may be permanently or semi-permanently attached to each other, for example by stitching.

When the printing press is operated, freshly printed substrates are supported by the flexible jackets installed over the transfer cylinders as the substrates are transferred from station to station within the printing press and finally distributed out of the printing press to a stacking apparatus. In an embodiment, it is thought that the free play of the flexible jacket promotes the flexible jacket expanding when the transfer cylinder rotates, providing a yieldable, cushioning support for the freshly printed substrates and allowing the flexible jacket to adhere to the freshly printed substrates. Further, it is thought that the free play of the flexible jacket promotes the flexible jacket moving with the printed substrate, thereby avoiding marking the freshly printed substrate with spurious inking and/or smearing the ink on the freshly printed substrate. While the structures of printing presses and transfer cylinders are well known, some examples of different printing presses and transfer cylinders will be discussed further hereinafter.

The present disclosure teaches an adjustment tool that promotes installing the flexible jacket over the transfer cylinder and optional base cover with the desired amount of free play. A first end of the flexible jacket is attached to a first edge of the transfer cylinder, for example a gripper edge of the transfer cylinder, the adjustment tool is attached to the transfer cylinder parallel to an axis of the transfer cylinder, the flexible jacket is brought around and pulled snug or taut over the transfer cylinder and over the adjustment tool, and a second end of the flexible jacket is attached to a second edge of the transfer cylinder, for example a tail edge of the transfer cylinder. After the flexible jacket is thus attached or coupled to the transfer cylinder, the adjustment tool is withdrawn from between the transfer cylinder and the flexible jacket, leaving the flexible jacket attached to the transfer cylinder with an amount of free play that is determined by the adjustment tool, for example determined by a thickness of the adjustment tool and/or a height of the adjustment tool above the transfer cylinder.

In an embodiment, the adjustment tool may have enough flexibility to bend away from printing press obstructions when removing. The adjustment tool may have flags at either end to reduce the likelihood that the adjustment tool may be overlooked and not withdrawn before resuming printing operations. The adjustment tool flags may be white or may be dyed with a distinctive color such as yellow, orange, red, or other highly visible color. The adjustment tool flags may be dyed or painted a bright contrasting color that contrasts with the color of the press and/or contrasts with the color of the flexible jacket 100. Rather than having flags, the adjustment tool may have its ends painted or printed with white or a distinctive color such as yellow, orange, red, or other highly visible color. In an embodiment, the whole of one side or both sides of the adjustment tool may be painted or printed with white or a distinctive color such as yellow, orange, red, or other highly visible color. The adjustment tool may be generally flat and may include printed information such as instructions for installing the flexible net, safety instructions, or a commercial message. Alternatively, the adjustment tool may be generally tubular and may include printed information on a label adhered to the outer diameter of the adjustment tool.

Figure 1B:
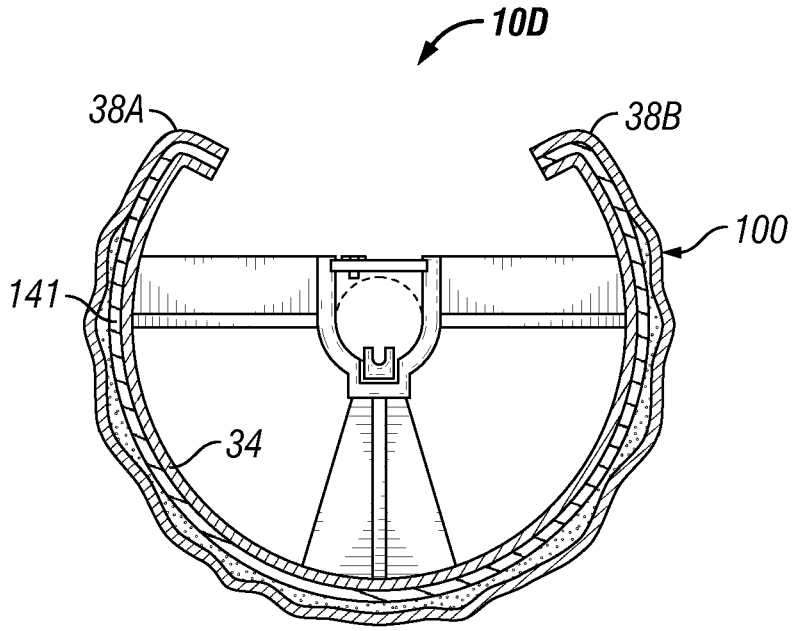
FIG. 1B is a second view of a transfer cylinder and a flexible jacket according to an embodiment of the disclosure.
Figure 1C:
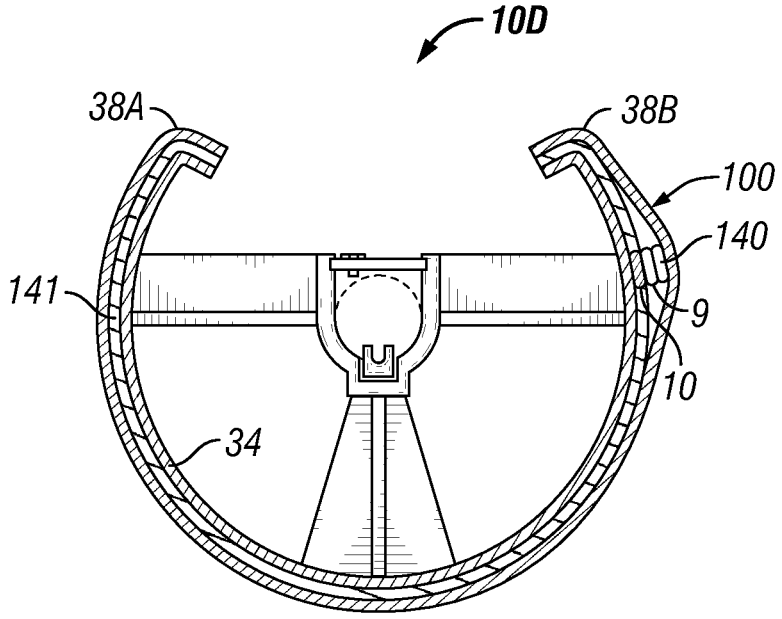
FIG. 1C is a section view of a transfer cylinder illustrating the adjustment tool and a flexible jacket attached thereon according to an embodiment of the disclosure.
Figure 1D:
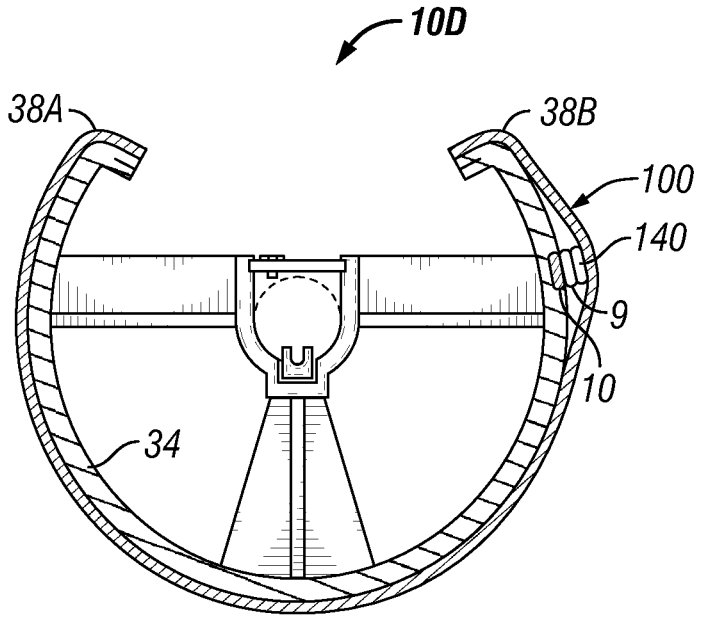
FIG. 1D is a section view of a base cover illustrating the adjustment tool and a flexible jacket attached thereon according to an embodiment of the disclosure.

Turning now to FIG. 1A and FIG. 1B, a first adjustment tool 140 is described. The first adjustment tool 140 in some contexts may be referred to by other names such as spoon, shim, wand, fixture, template, and other such names. FIG. 1A shows a cylinder rim 34 portion of a transfer cylinder, with a base cover 141 coupled to the cylinder rim 34, and a flexible jacket 100 coupled to the cylinder rim 34 over the base cover 141. The first adjustment tool 140 is shown placed between the base cover 141 and the flexible jacket 100, separating the flexible jacket 100 from the base cover 141. It is understood that the dimensions of FIG. 1A may not be to scale and that the height of the first adjustment tool 140 may be enhanced to more clearly illustrate its operation. In some embodiments, the base cover 141 may not be installed over the transfer cylinder, and in this case the first adjustment tool 140 would be placed between the transfer cylinder and the flexible jacket 100, with no intervening base cover 141. The base cover 141 may be referred to herein as the optional base cover 141.

The first adjustment tool 140 may be coupled to an attachment structure on the cylinder rim 34 or on the base cover 141. For example, in an embodiment, a patch or strip of hook type attachment material 9 coupled to the first adjustment tool 140 may couple to a patch or strip of loop type attachment material 11 coupled to the cylinder rim 34. Alternatively, the loop type attachment material 11 may be coupled to the first adjustment tool 140 and the hook type attachment material 9 may be coupled to the cylinder rim 34. The first adjustment tool 140 may couple to a patch of attachment material on an inner edge of the cylinder rim 34, for example on the inside surface of the transfer cylinder. The first adjustment tool 140 may be coupled to the base cover 141 or to the transfer cylinder by two-sided adhesive tape strip or tape patch on the transfer cylinder or base cover 141. The first adjustment tool 140 may be coupled to the base cover 141 or to the transfer cylinder by opposing magnets, a first magnet of a first polarity attached to the transfer cylinder and/or the base cover 141, a second magnet of a second polarity attached to the first adjustment tool 140. Other attachment structures for coupling the first adjustment tool 140 to the cylinder rim 34 or to the base cover 141 are also contemplated by the present disclosure. The flexible jacket 100 is attached tautly or snuggly over the transfer cylinder and the first adjustment tool 140.

In an other embodiment, however, the base cover 141 may be removed from the transfer cylinder and the flexible jacket 100 may be attached to the base cover 141 with free play while the base cover 141 is laid out flat, for example on a table. In some cases, the base cover 141 may not be attached to the transfer cylinder, and one or more pairs of base cover 141 and flexible jackets 100 may be made up in advance of need. It has been determined that the height of the first adjustment tool 140 may be greater when attaching the flexible jacket 100 to the base cover 141 with appropriate free play when the base cover 141 is off the transfer cylinder and laid out flat. Thus a different first adjustment tool 140 may be employed to install the flexible jacket 100 depending on whether the base cover 141 is installed on the transfer cylinder or laid out flat. When the flexible jacket 100 is attached to the base cover 141 laid out flat using the first adjustment tool 140, the first adjustment tool 140 need not be attached or secured to the base cover 141 as may have been desirable when the base cover 141 is attached to the transfer cylinder. When the base cover 141 is laid out flat, the first adjustment tool 140 may tend to remain in position without coupling to attachment structures on the base cover 141. Omitting the step and/or structures for coupling the first adjustment tool 140 to the base cover 141 may simplify and streamline the process for attaching the flexible jacket 100 to the base cover 141 with an effective amount of free play.

FIG. 1B shows the cylinder rim 34 portion of the transfer cylinder, the base cover 141, and the flexible jacket 100 after the first adjustment tool 140 has been withdrawn from between the base cover 141 and the flexible jacket 100. The flexible jacket 100 in FIG. 1B is no longer taut or snug but now has an amount of free play or end play illustrated by the black space between the flexible jacket 100 and the base cover 141. The amount of free play may be determined by the cross section of the first adjustment tool 140, for example a height and/or width of the first adjustment tool 140. It is understood that the dimensions of FIG. 1B may not be to scale and that the amount of free play may be enhanced to more clearly illustrate this aspect of the installed flexible jacket 100. It is contemplated that a variety of different sized adjustment tools 140 may be used with a printing press having many different cylinders having different clearances within the press to adjust the free play for flexible jackets 100 on these various cylinders. In an embodiment, one or more instances of the first adjustment tool 140 may be coupled to the transfer cylinder from a gripper edge to a tail edge of the transfer cylinder to promote installing the flexible jacket 100 with a desirable amount of free play across the transfer cylinder from gear edge to operator edge. A first instance of the first adjustment tool 140 may be installed along the gear edge and a second instance of the first adjustment tool 140 may be installed along the operator edge. Alternatively, a single instance of the first adjustment tool 140 may be installed along one of the gear edge and the operator edge. Additionally, a first instance of the first adjustment tool 140 may be installed proximate to and parallel to one of the gripper edge and the tail edge of the transfer cylinder at the same time that a second instance of the first adjustment tool 140 may be installed along the gear edge of the transfer cylinder, and a third instance of the first adjustment tool 140 may be installed along the operator edge of the transfer cylinder.

Figure 2A:
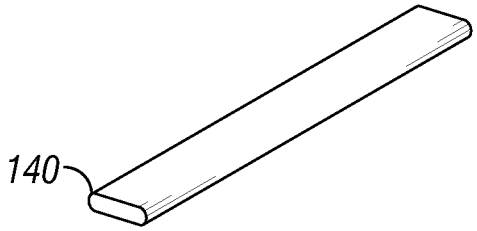
FIG. 2A is a view of an adjustment tool according to an embodiment of the disclosure.
Figure 2B:
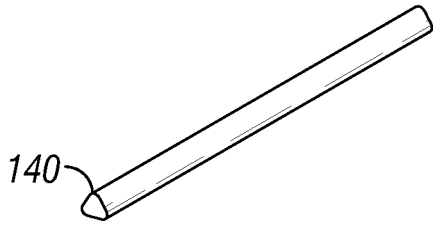
FIG. 2B is a view of an adjustment tool according to an embodiment of the disclosure.
Figure 2C:
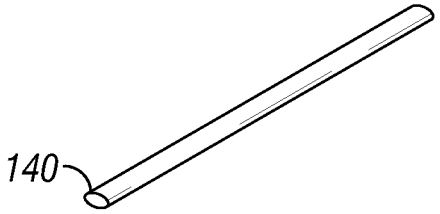
FIG. 2C is a view of an adjustment tool according to an embodiment of the disclosure.

Turning now to FIG. 2A, FIG. 2B, and FIG. 2C, adjustment tools 140 having different cross sectional geometries are discussed. In an embodiment, the first adjustment tool 140 may have a substantially rectangular cross section, for example, a rectangle with rounded or beveled edges as illustrated in FIG. 2A. Alternatively, the first adjustment tool 140 may have a triangular cross section, for example a triangle with rounded or beveled edges as illustrated in FIG. 2B. Alternatively, the first adjustment tool 140 may have a circular cross section as illustrated in FIG. 2C. While the first adjustment tool 140 is shown as solid in FIG. 2A, FIG. 2B, and FIG. 2C, in an embodiment the first adjustment tool 140 may be hollow. The first adjustment tool 140 may be curved in cross section. For example, the first adjustment tool 140 may be a hollow tube. In other embodiments, the first adjustment tool 140 may have other cross sectional geometry. The first adjustment tool 140 may have information printed on its surface, for example instructions for installing the flexible jacket 100, safety instructions, safety admonitions, contact information to order more consumable printing equipment, for example flexible jackets 100, marketing information, or other information. Alternatively, the information may be printed on a label that is affixed to the first adjustment tool 140.

The first adjustment tool 140 may be comprised of a variety of materials including vinyl, polyurethane, polystyrene, rubber, foam (such as a foam strip), plastic, and/or phenolic materials. The first adjustment tool 140 may be comprised of metal, wood, ceramic, or glass. In an embodiment, the first adjustment tool 140 may be comprised of a plurality of spherical or cylindrical beads strung on a string, chord, wire, or cable. The beads may be comprised of one or more of wood, ceramic, glass, or metal. The beads may be strung with sufficient space to promote withdrawal of the first adjustment tool 140 from between the transfer cylinder and the flexible jacket 100, for example bending to avoid press frame obstructions off the end of the transfer cylinder or other obstructions. The first adjustment tool 140 may be comprised of rope or cord. The first adjustment tool 140 may comprise a chain. The first adjustment tool 140 may comprise a plurality of rigid or semi-rigid segments coupled together by hinges or linked eyes, such that when withdrawing the first adjustment tool 140 the segments may pivot on the hinges or linked eyes as each segment clears the flexible jacket 100. The length of the first adjustment tool 140 may be at least equal to the width of the flexible jacket 100, for example at least as long as one of a gripper edge of the flexible jacket 100 from operator side to gear side or a tail edge of the flexible jacket 100 from operator side to gear side.

Figure 2D:
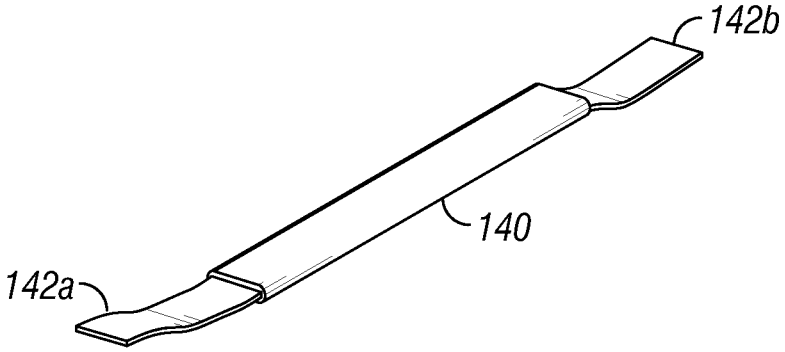
FIG. 2D is a view of an adjustment tool according to an embodiment of the disclosure.

Turning now to FIG. 2D, in an embodiment the first adjustment tool 140 may comprise a device or article at one or more ends to draw the attention of an operator to reduce the chances that the first adjustment tool 140 may be forgotten between the flexible jacket 100 and the transfer cylinder when the press is put into operation. The device or article may be any of a flag, a tab, a ribbon, a segment of tape. In an embodiment, one or more flags 142 or other device may be attached to the ends of the first adjustment tool 140, for example a first flag 142*a* attached to a first end of the first adjustment tool 140 and a second flag 142*b* attached to a second end of the first adjustment tool 140. The one or more flags 142 or other device may help the pressman to remember to withdraw the first adjustment tool 140 after attaching the flexible jacket 100, before placing the printing press into operation. The flags 142 or other device may be white or an easily visible color such as yellow, orange, red, or other color. The color of the flags 142 or other device may be selected to contrast with the color of the flexible jacket 100 and/or to contrast with the color of the press. The flags 142 or other device may have alternating stripes of different colors. In an embodiment, the first adjustment tool 140 may comprise one or more bells at either or both ends. The bell, for example a generally spherical metal bell enclosing a loose ringer, may make the pressman mindful of the first adjustment tool 140 and remind him to remove the first adjustment tool 140.

Figure 2E:
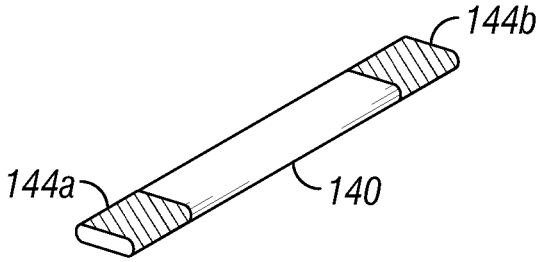
FIG. 2E is a view on an adjustment tool according to an embodiment of the disclosure.

Turning now to FIG. 2E, in an embodiment one or more ends 144 of the first adjustment tool 140 may be painted or printed white or an easily visible color such as yellow, orange, red or other color. The color of the ends 144 of the first adjustment tool 140 may be selected to contrast with the color of the flexible jacket 100. One or more ends 144 of the first adjustment tool 140 may be painted or printed with alternating stripes of different colors. The colored ends may help the pressman to remember to withdraw the first adjustment tool 140, for example first end 144*a* and second end 144*b*, after attaching the flexible jacket 100, before placing the printing press into operation. Alternatively, a radio frequency identity (RFID) tag may be attached to one or more ends 144 of the first adjustment tool 140, and an RFID reader proximate to the end of the transfer cylinder, for example a gear side of the transfer cylinder, may read the presence of the RFID tag. When the RFID tag is detected as present, the RFID reader may send a signal to a controller that prevents the press from being placed into operation when the RFID tag of the first adjustment tool 140 is detected.

Figure 2F:
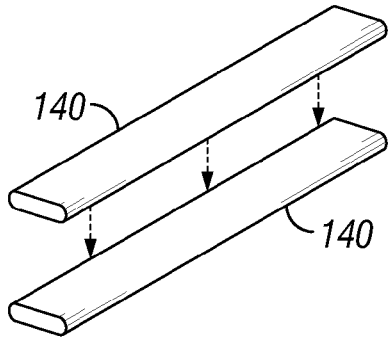
FIG. 2F is a view of two adjustment tools according to an embodiment of the disclosure.
Figure 2G:
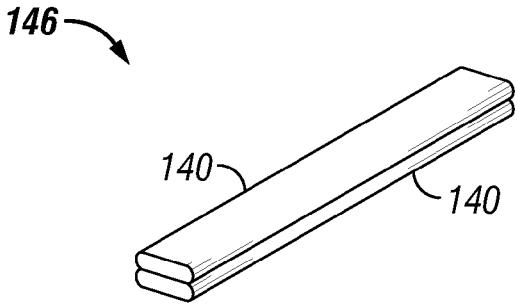
FIG. 2G is a view of two adjustment tools combined to form a thicker combined adjustment tool.

Turning now to FIG. 2F, two first adjustment tools 140 are shown being mated to produce a combined adjustment tool 146 as illustrated in FIG. 2G. By coupling together the two first adjustment tools 140 a height of the combined adjustment tool 146 may be made to be greater than the height of either first adjustment tool 140 used alone. The increased height of the combined adjustment tool 146 may be desired in some circumstances to provide additional end play, for example for a rotating cylinder that is separated by a greater amount from other proximate cylinders or machinery. The first adjustment tools 140 may be coupled together, for example by hook and loop type attachment surfaces on corresponding adjustment tools 140. For example, one of the first adjustment tools 140 may have one or more loop type attachment strips coupled to the side facing another of the first adjustment tools 140. The other first adjustment tool 140 may have one or more hook type attachment strips coupled to the side facing the one of the first adjustment tools 140. The two first adjustment tools 140 may be coupled together by placing the first adjustment tools 140 together and gently working their corresponding hook or loop attachment strips against each other. As an alternative to the combination of two first adjustment tools 140 to promote installing the flexible jacket 100 with increased free play, the first adjustment tool 140 may couple to a magnetic strip and/or to a metal strip, and a height of the first adjustment tool 140 may be incremented by adding one or more magnetic strips to the first adjustment tool 140.

Some embodiments of the present disclosure contemplate a flexible jacket 100 comprised of a fluoropolymer. For further details about flexible jackets comprised of fluoropolymer, reference U.S. patent application Ser. No. 12/343,481 entitled "Anti-marking Jackets Comprised of Fluoropolymer and Methods of Using in Offset Printing," by Howard W. DeMoore, et al., filed Dec. 24, 2008 which was incorporated by reference above. Some embodiments of the present disclosure contemplate a flexible jacket 100 that define one or more alignment stripes. For further details about flexible jackets defining alignment stripes see U.S. Pat. No. RE39,305 entitled "Anti-static, Anti-smearing Pre-stretched and Pressed Flat, Precision-cut Striped Flexible Coverings for Transfer cylinders," which was incorporated by reference above.

Some embodiments of the present disclosure contemplate a flexible jacket 100 that is comprised of a loosely woven cotton or other natural fiber material. Some embodiments contemplate a flexible jacket 100 that is comprised of a mylar film or film of another material. Some embodiments contemplate a flexible jacket 100 that is comprised of a beaded material, for example a film that has glass beads and/or ceramic beads adhered or fused with the film.

Figure 2H:
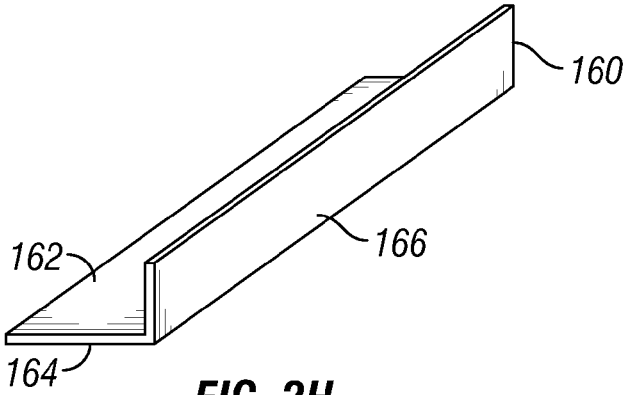
FIG. 2H is a view of an adjustment tool according to an embodiment of the disclosure.
Figure 2I:
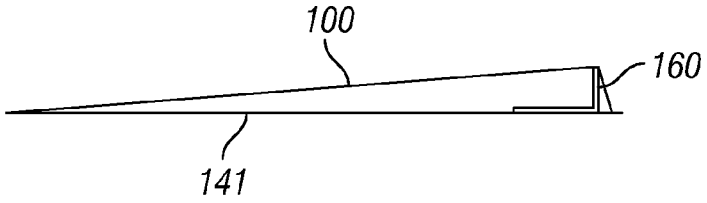
FIG. 2I is a view of an adjustment tool according to an embodiment of the disclosure.

Turning now to FIG. 2H, a second adjustment tool 160 is described. In an embodiment, the second adjustment tool 160 may be an L-shaped structure. In another embodiment, however, the second adjustment tool 160 may have other shapes, for example a U-shaped structure with different segments of the cross-section having different lengths and other open polygonal cross-sections. The second adjustment tool 160 may be constructed of metal, plastic, wood, ceramic, or other material. The second adjustment tool 160 may desirably be used to adjust free play of the flexible jacket 100 when attaching to a base cover 141 laid out on a flat surface. In an embodiment, the second adjustment tool 160 may have its faces painted in different colors or surface etched, incised, or molded with different designs or patterns. For example, a first face 162 of the second adjustment tool 160 may have a first color, a second face 164 of the second adjustment tool 160 may have a second color, and a third face 166 of the second adjustment tool 160 may have a third color. These different surface treatments may promote describing to press operators how to adjust the flexible jacket 100 when attaching to a base cover 141 laid out on a flat surface. For example, place the third face 166 upright and flush with an edge of an attachment structure coupled to a first end of the base cover 141, attach the flexible jacket 100 to the attachment structure coupled to the first end of the base cover 141, bring the flexible jacket 100 over the second adjustment tool 160, and attach the flexible jacket 100 without free play to another attachment structure coupled to an end of the base cover 141 opposite the first end of the base cover 141, and then remove the second adjustment tool 160 from between the flexible jacket 100 and the base cover 141. This scenario is illustrated in FIG. 2I.

Figure 2J:
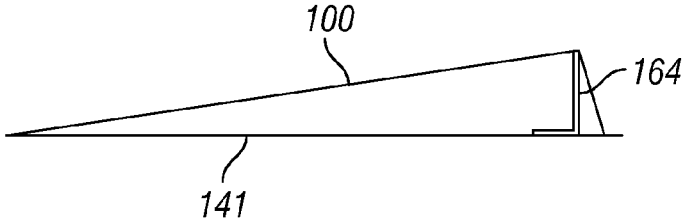
FIG. 2J is a view of an adjustment tool according to an embodiment of the disclosure.
Figure 2K:
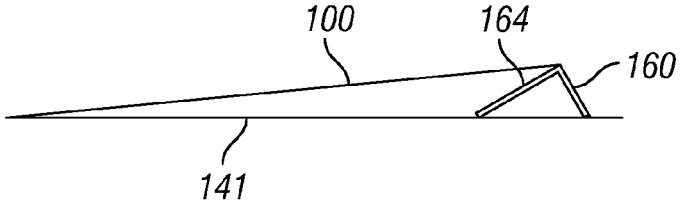
FIG. 2K is a view of an adjustment tool according to an embodiment of the disclosure.

Alternatively, place the second face 164 upright and flush with the edge of the attachment structure coupled to the first end of the base cover 141, attach the flexible jacket 100 to the attachment structure coupled to the first end of the base cover 141, bring the flexible jacket 100 over the second adjustment tool 160, and attach the flexible jacket 100 without free play to the attachment structure coupled to the end of the base cover 141 opposite the first end of the base cover 141, and then remove the second adjustment tool 160 from between the flexible jacket 100 and the base cover 141. This scenario is illustrated in FIG. 2J. Alternatively, place the second attachment tool 160 on the base cover 141 with both the second face 164 and the third face 166 upwards and with the edge of the second face 166 flush with the edge of the attachment structure coupled to the first end of the base cover 141, attach the flexible jacket 100 to the attachment structure coupled to the first end of the base cover 141, bring the flexible jacket 100 over the second adjustment tool 160, and attach the flexible jacket 100 without free play to the attachment structure coupled to the end of the base cover 141 opposite the first end of the base cover 141, and then remove the second adjustment tool 160 from between the flexible jacket 100 and the base cover 141. This scenario is illustrated in FIG. 2K.

In an embodiment, one of the third face 166 and the faces 162, 164 may extend beyond the width of the base cover 141, for example to provide a reminder to a press operator to remove the second attachment tool 160 after installing the flexible jacket 100 on the base cover 141. Alternatively, the faces 162, 164, 166 may have the same length and may extend beyond the width of the base cover 141. Alternatively, the faces 162, 164, 166 may be substantially the same length as the width of the base cover 141. In an embodiment, however, the faces 162, 164, 166 may be less than the width of the base cover 141.

The second adjustment tool 160 may be used for installing flexible jackets 100 on base covers 141 in different environments. For example, the flexible jacket 100 may be installed on the base cover 141 with the second adjustment tool 160 aligned in a first manner to provide free play of the flexible jacket 100 that is suitable to a first press environment while the flexible jacket 100 may be installed on the base cover 141 with the second adjustment tool 160 aligned in a second manner to provide free play of the flexible jacket 100 that is suitable to a second press environment. Press environments may vary based on printing different substrates, e.g., substrates having different thicknesses, based on clearances between shafts of the press, and based on other press parameters. The faces 162, 164, 166 of the second adjustment tool 160 may be sized to provide a minimum amount of free play when installing the flexible jackets 100, a medium amount of free play when installing the flexible jackets 100, and when maximum amount of free play for installing the flexible jackets 100. The second adjustment tool 160 may be adapted to provide different amounts of free play when installing the flexible jackets 100 by coupling one or more magnetic strips to the second adjustment tool 160.

Figure 3:
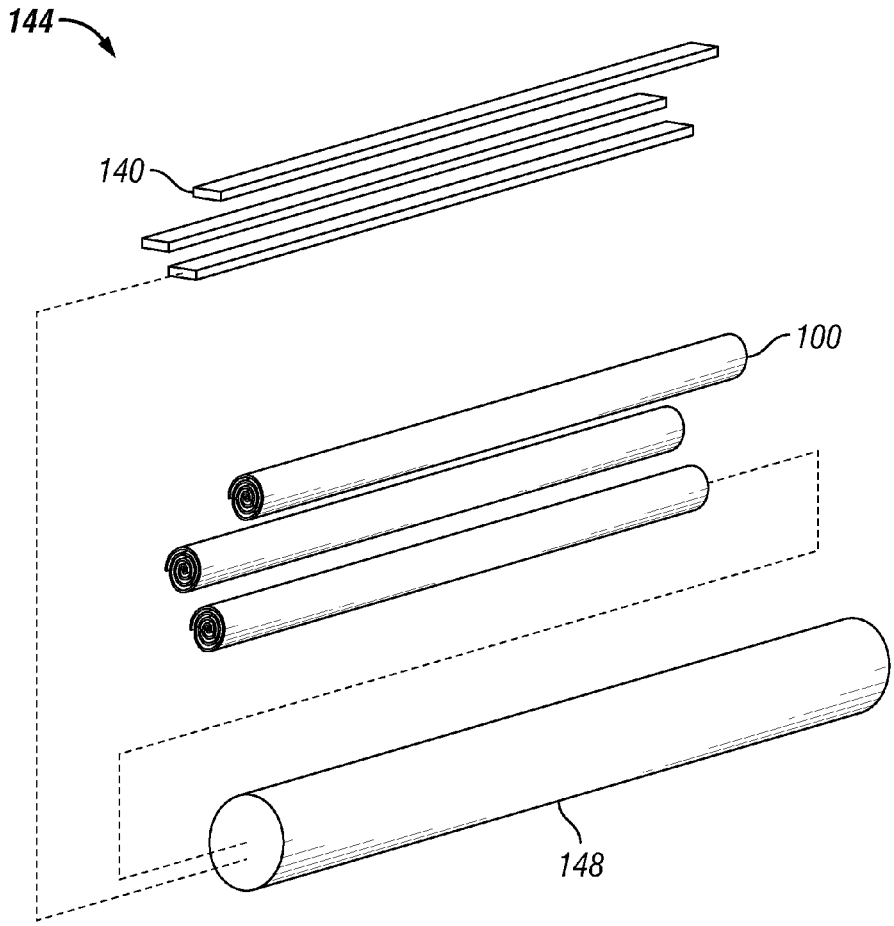
FIG. 3 is an illustration of a kit according to an embodiment of the disclosure.

Turning now to FIG. 3, a kit 144 is described. The first adjustment tool 140 and/or the second adjustment tool 160 may be provided as part of a kit comprising the adjustment tool 140, a plurality of flexible jackets 100, and a shipping container 148. The shipping container 148 may be any size that is suitable for carrying a quantity of flexible jackets. In an embodiment, the shipping container 148 may be a cardboard, laminated cardboard, plastic, or metal tube or cylinder of various lengths and diameter. The shipping container 148 may be a folded cardboard or laminated cardboard column, for example a triangular column. The shipping container 148 may be formed of other materials and have other shapes. The shipping container 148 may be about 29 inches long, about 40 inches long, about 46 inches long, or some other length. The kit 144 may comprise 6 flexible jackets 100, 8 flexible jackets 100, 10 flexible jackets 100, or some other suitable number of flexible jackets. The kit 144 may comprise a single adjustment tool 140 or a plurality of adjustment tools 140. The kit 144 may comprise a plurality of adjustment tools 140 of different sizes whereby different amounts of free play may be provided for the flexible jackets 100, for example for use with different cylinders of the printing press or cylinders in different positions within the printing press. Adjustment tools 140 having different sizes also promote adjusting the amount of free play provided for the flexible jacket 100 when substrates having different thickness, different stiffness, different ink absorption, or other different properties are printed. Adjustment tools 140 having different sizes promote adjusting the amount of free play provided for the flexible jacket 100 to accommodate changes of press settings and/or differences between different presses. Additionally, as described further above, different sized adjustment tools 140 promote installing the flexible jacket 100 to the base cover 141 while the base cover 141 is installed over the transfer cylinder or while the base cover 141 is removed from the transfer cylinder and laid out flat. In an embodiment, the shipping container 148 itself may serve as an adjustment tool 140, for example an adjustment tool 140 suitable for adjusting an effective amount of free play when attaching the flexible jacket 100 to the base cover 141 when the base cover 141 is removed from the transfer cylinder and laid out flat. The kit 144 may contain a single second adjustment tool 160.

Figure 4:
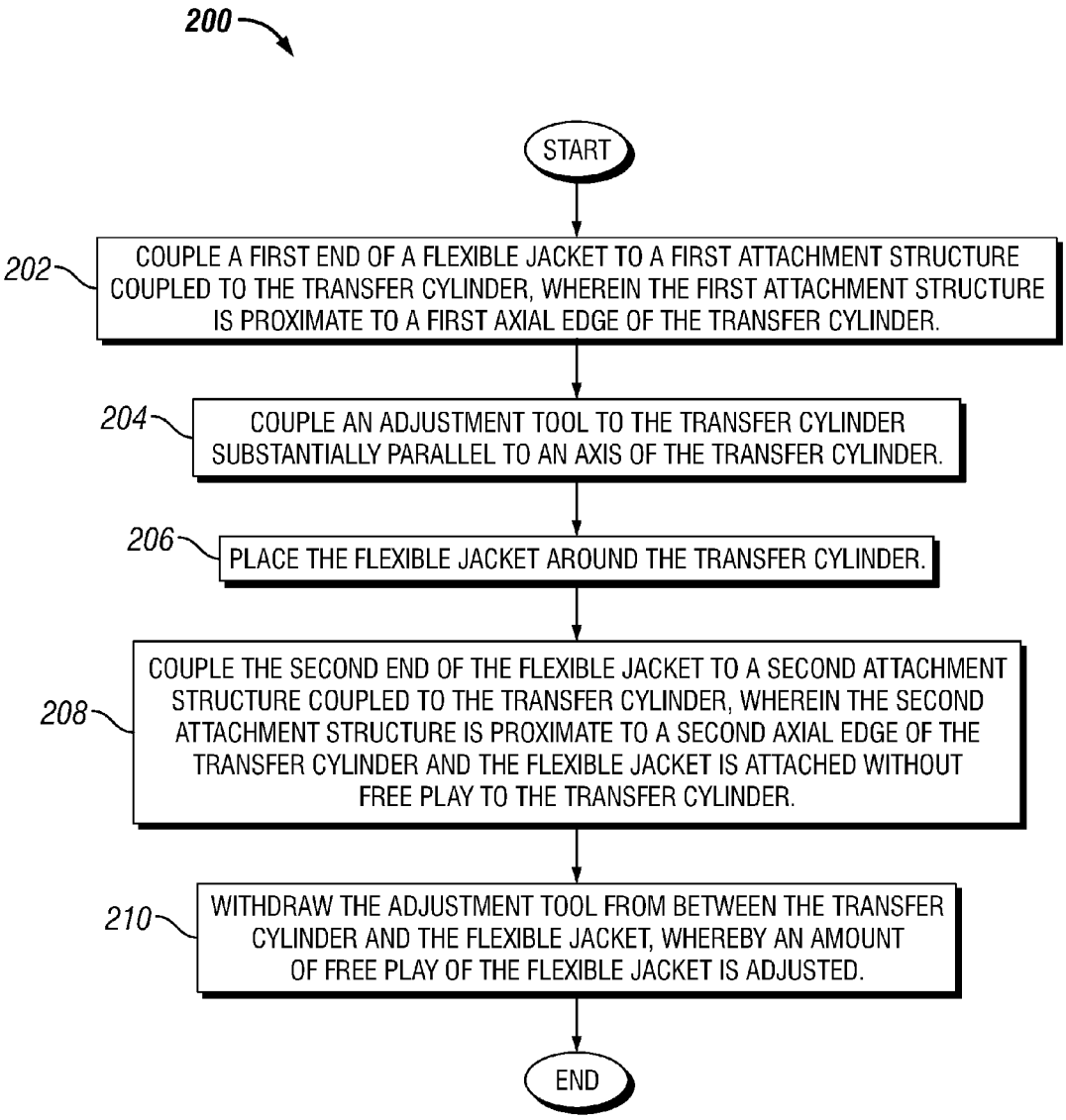
FIG. 4 is a flow chart of a method of adjusting free play or end play of a flexible jacket using the adjustment tool according to an embodiment of the disclosure.

Turning now to FIG. 4, a method 200 is described. At block 202, a first end of a flexible jacket 100, for example a gripper end, is coupled to a first attachment structure coupled to the transfer cylinder, wherein the first attachment structure is proximate to a first axial edge of the transfer cylinder, for example a gripper edge of the transfer cylinder. In an embodiment, the first attachment structure may be coupled directly to the transfer cylinder. Alternatively, the first attachment structure may be coupled to an optional base cover 141, where the optional base cover 141 is in turn coupled to the transfer cylinder.

At block 204, an adjustment tool 140 is coupled to the transfer cylinder substantially parallel to an axis of the transfer cylinder. The adjustment tool 140 may be coupled to the transfer cylinder and/or coupled to the optional base cover 141 by any of the means described above. In an embodiment, the adjustment tool 140 may be first configured to provide a desirable amount of free play by adding or coupling two or more adjustment tools 140 together, which may be referred to as incrementing a thickness or height of the adjustment tool 140, or by removing an adjustment tool 140 from a combination of adjustment tools 140, which may be referred to as decrementing a thickness or height of the adjustment tool 140. Alternatively, in an embodiment, a plurality of adjustment tools 140 may be coupled to the transfer cylinder and/or coupled to the optional base cover 141. It is understood that the processing of block 204 may be performed before the processing of block 202. In some cases it may be more convenient to couple the adjustment tool 140 or two or more adjustment tools 140 to the transfer cylinder and/or to the optional base cover 141 before attaching the first end of the flexible jacket 100 to the transfer cylinder.

At block 206, the flexible jacket 100 is placed around the transfer cylinder and optional base cover 141. At block 208, the second end of the flexible jacket 100, for example a tail end, is coupled to a second attachment structure coupled to the transfer cylinder and/or the optional base cover 141, wherein the second attachment structure is proximate to a second axial edge of the transfer cylinder and the flexible jacket 100 is attached without free play to the transfer cylinder. In some contexts, the flexible jacket 100 may be said to be attached tautly or snuggly during block 208. The flexible jacket 100 is attached so there is little or no gap between the transfer cylinder and/or optional base cover 141 and the flexible jacket 100, with the possible exception of the location of the adjustment tool 140 and immediately proximate to the adjustment tool 140. The flexible jacket 100 is attached without stretching the material of the flexible jacket 100 or without enough stretching to make the flexible jacket 100 taut.

At block 210, the adjustment tool 140 is withdrawn from between the transfer cylinder and the flexible jacket 100. Upon withdrawal of the adjustment tool 140, the flexible jacket 100 is left attached to the transfer cylinder and/or optional base cover 141 with an amount of free play or end play that is determined by the adjustment tool 140. The use of the adjustment tool 140 promotes installing flexible jackets 100 with a repeatable amount of free play or end play. The use of the adjustment tool 140 promotes easy instruction of new personnel in how to attach flexible jackets 100 with the appropriate amount of free play or end play.

Figure 5A:
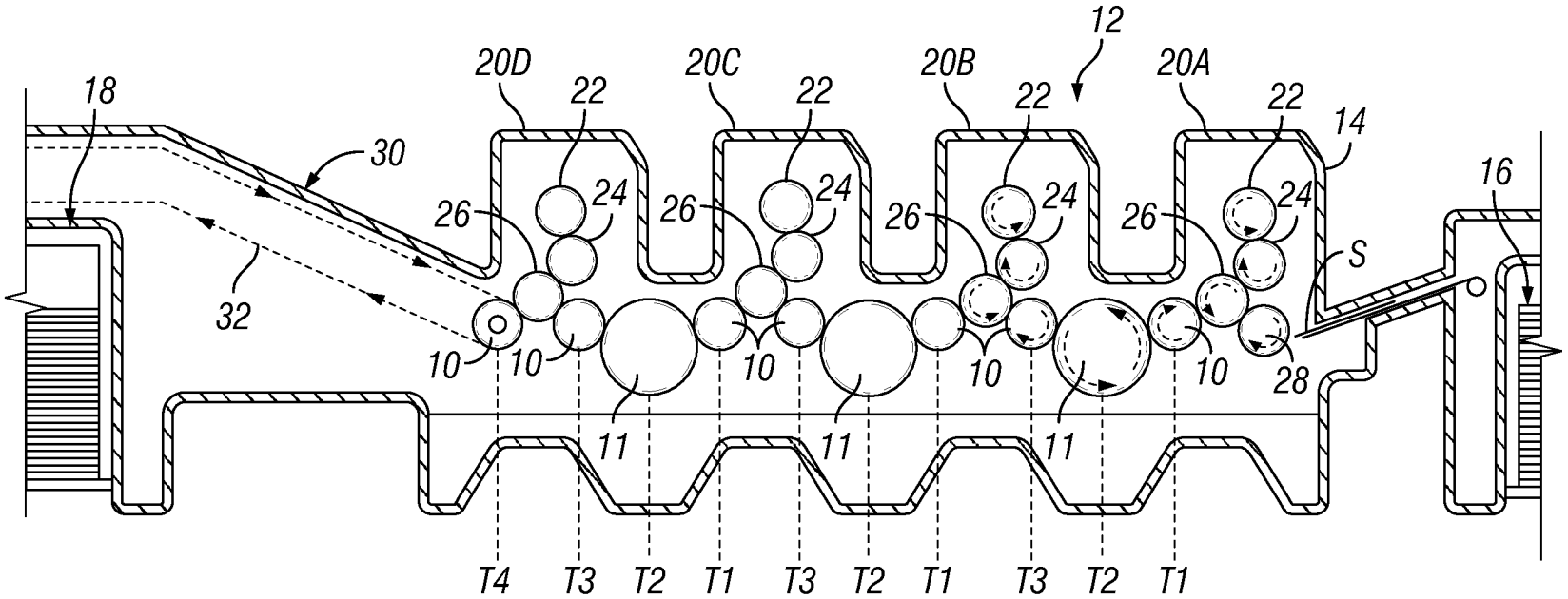
FIG. 5A is a schematic side elevational view showing multiple transfer cylinders installed at substrate transfer positions in a four color rotary offset printing press of a type made by Heidelberg Druckmaschinen Aktiengesellschaft.
Figure 5B:
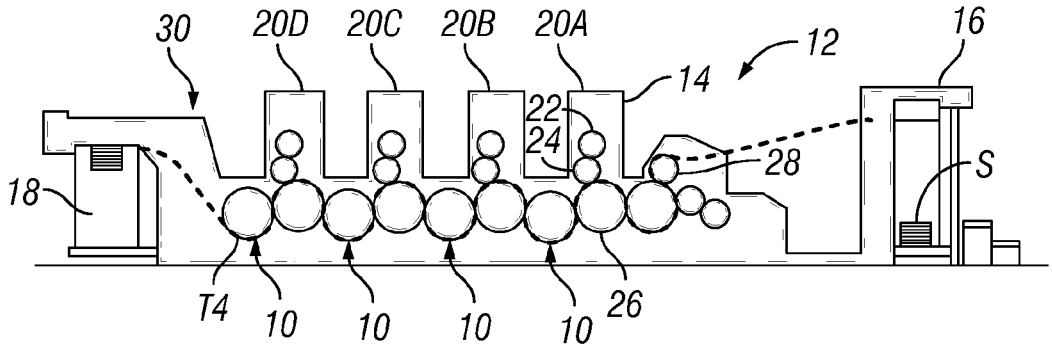
FIG. 5B is a schematic side elevational view showing multiple transfer cylinders installed at substrate transfer positions in a four color rotary offset printing press of the Lithrone Series made by Komori Corp.

Referring to FIG. 5A and FIG. 5B, two representative presses are now described. A press 12 includes a press frame 14 coupled on its input end to a sheet feeder 16 from which sheets, herein designated S, are individually and sequentially fed into the press. At its delivery end, the press 12 is coupled to a sheet stacker 18 in which the printed sheets are collected and stacked. Interposed between the sheet feeder 16 and the sheet stacker 18 are four substantially identical sheet printing units 20A, 20B, 20C, and 20D which are capable of printing different color inks onto the sheets as they are transferred through the press.

As illustrated in FIG. 5A and FIG. 5B, each printing press is of conventional design, and includes a plate cylinder 22, a blanket cylinder 24, and an impression cylinder 26. Freshly printed sheets S from the impression cylinder 26 are transferred to the next printing press by a transfer cylinder 10 or a plurality of transfer cylinders 10. The initial printing unit 20A is equipped with a sheet in-feed roller 28 which feeds individual sheets one at a time from the sheet feeder 16 to the initial impression cylinder 26. In an embodiment, the transfer cylinder 10 may be painted a color that promotes discernment of negatively defined visual stripes in the optional base cover by a print operator.

The freshly printed sheets S are transferred to the sheet stacker 18 by a delivery conveyor system, generally designated 30. The delivery conveyor system 30 is of conventional design and includes a pair of endless delivery gripper chains 32 carrying transversely disposed gripper bars, each having gripper elements for gripping the leading edge of a freshly printed sheet S as it leaves the impression cylinder 26 at the delivery position T4. As the leading edge of the printed sheet S is gripped by the grippers, the delivery gripper chains 32 pull the gripper bars and sheet S away from the impression cylinder 26 and transport the freshly printed sheet S to the sheet delivery stacker 18.

Referring to FIG. 5A, an intermediate transfer cylinder 11 receives sheets printed on one side from the transfer cylinder 10 of the preceding printing unit 20. Each intermediate transfer cylinder 11, which is of conventional design, typically has a diameter twice that of the transfer cylinder 10, and is located between two transfer cylinders 10, at interstation transfer positions T1, T2 and T3, respectively. The impression cylinders 26, the intermediate transfer cylinders 11, the transfer cylinders 10, as well as the sheet in-feed roller 28, are each provided with sheet grippers which grip the leading edge of the sheet to pull the sheet around the cylinder in the direction as indicated by the associated arrows. The transfer cylinder 10 in the delivery position T4 is not equipped with grippers, and includes instead a large longitudinal opening A, which provides clearance for passage of the chain driven delivery conveyor gripper bars. In some printing press installations, an artificial radiation source, for example an ultraviolet lamp and/or an infrared lamp, may be mounted to radiate semi-directly or directly onto the interstation transfer positions T1, T2, and T3. The artificial radiation may be employed to cure and/or set the wet ink on printed substrates as they pass through the printing press.

Figure 6:
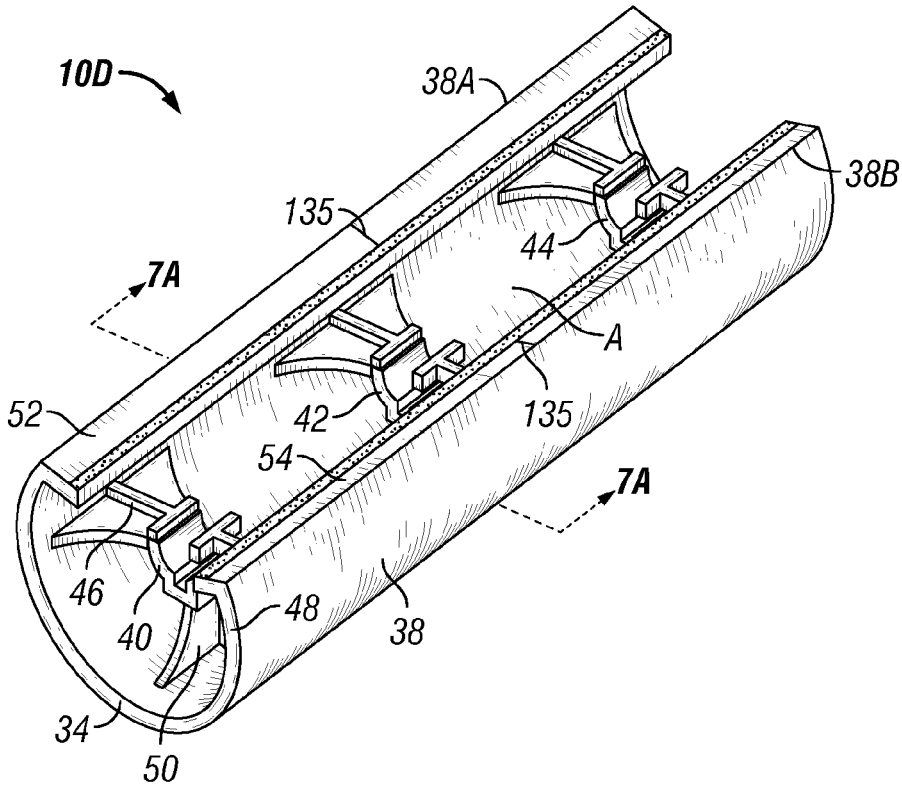
FIG. 6 is a perspective view of a transfer cylinder of a type commonly used on printing presses made by Heidelberg Druckmaschinen Aktiengesellschaft.
Figure 7A:
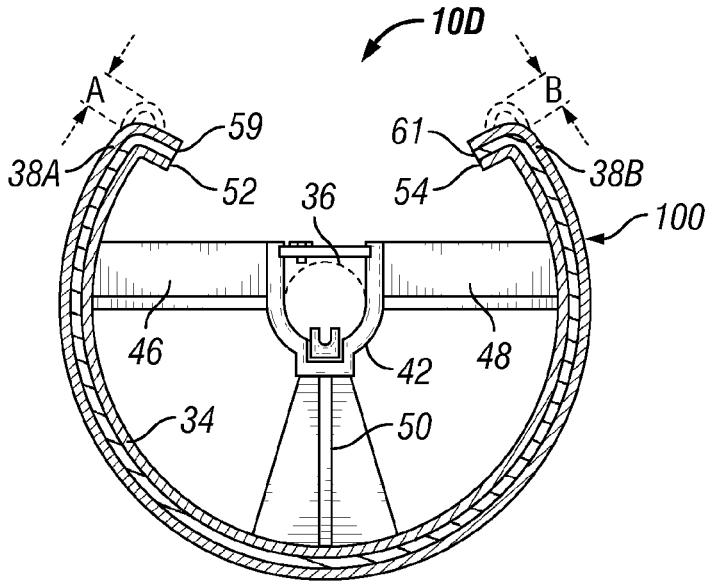
FIG. 7A is a cross-sectional view of a transfer cylinder taken along line 15-15 of FIG. 5 having an integrated, anti-marking cover installed thereon.

Referring now to FIGS. 6 and 7A, a preferred transfer cylinder 10D is shown for use with the Heidelberg printing press of FIG. 5A. The flexible jacket 100 and the optional base cover described herein above are installed on a transfer cylinder 10D on the last printing unit 20D of the press 12 in the delivery position (T4) and has a cylindrical rim 34, which is supported for rotation on the press frame 14 by a rotatable delivery shaft 36. The external cylindrical surface 38 of the cylindrical rim 34 has a gap "A" extending longitudinally along the length of the transfer cylinder 10D and circumferentially between gripper edge 38A and tail edge 38B, respectively. The transfer cylinder 10D is attached to the delivery shaft 36 by longitudinally spaced hubs 40, 42 and 44. Additionally, center alignment marks 135 are formed on the cylinder flanges portions 52, 54 and on the external cylindrical surface 38 of the cylindrical rim 34, as shown in FIG. 6. The purpose of the center alignment marks 135 is to facilitate the precise alignment and attachment of the flexible jacket 100 and/or the optional base cover to the transfer cylinder 10. In an embodiment, a center alignment mark 135 may also be provided on the flexible jacket 100 and/or the optional base cover. The center alignment mark 135 may be distinguished from the visible stripes at least by the fact that the center alignment mark 135 is substantially perpendicular to the axis of the transfer cylinder 10 while the visible stripes are substantially parallel to the axis of the transfer cylinder 10.

The hubs 40, 42, and 44 are connected to the cylindrical rim 34 by webs 46, 48 and 50, and support the transfer cylinder 10D for rotation on the delivery shaft 36 of the printing press 12 in a manner similar to the mounting arrangement disclosed in U.S. Pat. No. 3,791,644. In the embodiment shown in FIG. 6, the delivery cylinder 10D includes opposed cylinder flanges 52, 54, which extend generally inwardly from the surface of the cylindrical rim portion 34. The flanges 52 and 54 include elongated flat surfaces for securing the flexible jacket 100 and the optional base cover as described below. As described herein, transfer cylinders 10 may have alternative configurations for accommodating the various means for releasably attaching the flexible jacket 100 and the optional base cover to the transfer cylinder 10 as described herein.

Figure 7B:
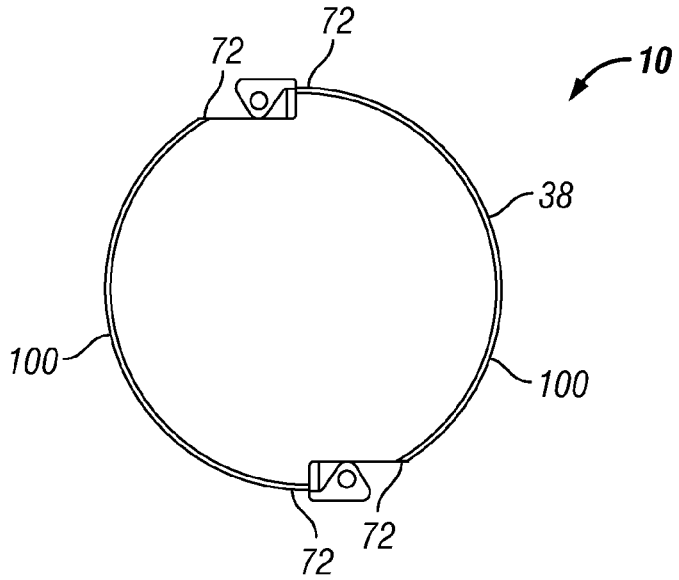
FIG. 7B is a cross-sectional view of a transfer cylinder of a type commonly used on Lithrone Series printing presses made by Komori Corp.

Referring to FIG. 7B, a cross-sectional view of preferred transfer cylinder 10 is shown for use with the Komori Lithrone Series printing press of FIG. 5B. Transfer cylinder 10 is designed and configured to accept a pair of flexible jackets 100, with a first flexible jacket 100 covering about one-half of the cylindrical surface 38 of the transfer cylinder 10 and a second flexible jacket 100 covering about the remaining one-half of the cylindrical surface 38. The flexible jacket 100 is releasably attached to the transfer cylinder 10 at the jacket tail edge and the jacket gripper edge with flat clamp bar 72 held in place with a series of spring loaded screws spaced along the length of the clamp bar 72. In some cases, the flexible jacket 100 is attached by various means including, but not limited to, hook and loop fabric material such as VELCRO that mates adheringly to the flexible jacket 100, an adhesive strip or tape, and other adhering means.

The function and operation of the transfer cylinders 10 and associated grippers of the printing units 20 are believed to be well known to those familiar with multi-color sheet fed presses, and need not be described further except to note that the impression cylinder 26 functions to press the sheets against the blanket cylinders 24 which applies ink to the sheets, and the transfer cylinders 10 guide the sheets away from the impression cylinders 26 with the wet printed side of each sheet facing against the support surface of the transfer cylinder 10. Since each transfer cylinder 10 supports the printed sheet with the wet printed side facing against the transfer cylinder support surface, the transfer cylinder 10 is provided with the flexible jacket 100 and the optional base cover as described herein. The flexible jacket 100 and the optional base cover are releasably attached to the transfer cylinder 10 by means for releasably attaching the flexible jacket 100 and the optional base cover to a transfer cylinder 10. In an embodiment shown in FIG. 7A, the flexible jacket 100 is connected to the transfer cylinder flanges 52 and 54 by the hook and loop (i.e., VELCRO) fastener strips 59, 61. Alternatively, the flexible jacket 100 may be, at least partially, connected to the transfer cylinder 10 using adhesive strip, as described above. In an embodiment shown in FIG. 7A, the flexible jacket 100 may be attached to the transfer cylinder flanges 52 and 54 by mechanical mechanisms, for example by mechanical fasteners such as screws; mechanical take up reels or any other forms of mechanical roll up bars (often referred to collectively as reel cylinders); and the like. Upon installation of the flexible jacket 100 and the optional base cover, the flexible jacket 100 is movable relative to the transfer cylinder 10 and the optional base cover as described previously.

In an embodiment, when installed over the transfer cylinder 10, the flexible jacket 100 may extend across the entire width of the transfer cylinder 10, for example from an operator edge to a gear edge of the transfer cylinder 10. In another embodiment, when installed over the transfer cylinder 10, the flexible jacket 100 may extend across the entire width of the transfer cylinder 10, for example from the operator edge to the gear edge of the transfer cylinder 10, and around behind the operator edge and the gear edge, for example to attach to a hook-and-loop fabric strip adhered on to the inner diameter of the transfer cylinder 10. In another embodiment, when installed over the transfer cylinder 10, the flexible jacket 100 may not extend across the entire width of the transfer cylinder 10, for example from the operator edge to the gear edge of the transfer cylinder 10, but may leave an uncovered margin along one or both of the operator edge and the gear edge of the transfer cylinder. In an embodiment, the base cover 141, likewise, may not extend across the entire width of the transfer cylinder 10, for example from the operator edge to the gear edge of the transfer cylinder 10, but may leave an uncovered margin along one or both of the operator edge and the gear edge of the transfer cylinder 10. In an embodiment, the base cover may be about as wide as the transfer cylinder 10, for example extending from the operator edge to the gear edge of the transfer cylinder 10, while the flexible jacket 100 does not extend from the operator edge to the gear edge of the transfer cylinder 10.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What we claim is:

1. In a printing press having a transfer cylinder for transferring a freshly printed substrate, a method of preparing the printing press for printing, comprising:

coupling an adjustment tool to the transfer cylinder substantially parallel to an axis of the transfer cylinder;

coupling a first end of a flexible jacket to a first attachment structure coupled to the transfer cylinder, wherein the first attachment structure is proximate to a first axial edge of the transfer cylinder;

placing the flexible jacket around the transfer cylinder and over the adjustment tool;

coupling the second end of the flexible jacket to a second attachment structure coupled to the transfer cylinder, wherein the second attachment structure is proximate to a second axial edge of the transfer cylinder, wherein the flexible jacket is coupled to the first attachment structure and the second attachment structure without free play when the adjustment tool is disposed between the transfer cylinder and the flexible jacket; and withdrawing the adjustment tool from between the transfer cylinder and the flexible jacket while the flexible jacket remains coupled to the first attachment structure and the second attachment structure, whereby an amount of free play of the flexible jacket remains.

2. The method of claim 1, wherein the adjustment tool is at least as long as one of a width of a gripper edge of the flexible jacket or a width of a tail edge of the flexible jacket.

3. The method of claim 1, wherein the adjustment tool is coupled to one of a hooks attachment structure or a loops attachment structure that is attached to the transfer cylinder.

4. The method of claim 1, wherein a base cover is coupled to the transfer cylinder and the adjustment tool is coupled to the transfer cylinder.

5. The method of claim 4, wherein the adjustment tool is coupled to one of a hooks attachment structure or a loops attachment structure that is attached to the base cover.

6. The method of claim 1, further comprising coupling a second adjustment tool to the transfer cylinder substantially parallel to the axis of the transfer cylinder prior to placing the flexible jacket around the transfer cylinder and withdrawing the second adjustment tool from between the transfer cylinder and the flexible jacket, whereby the amount of free play of the flexible jacket remains.

7. The method of claim 6, wherein the second adjustment tool has a different predetermined thickness than the first adjustment tool.

8. The method of claim 1, further comprising incrementing a thickness of the adjustment tool, whereby the amount of free play of the flexible jacket is adjusted.

9. The method of claim 1, further comprising decrementing a thickness of the adjustment tool prior to placing the flexible jacket around the transfer cylinder, whereby the amount of free play of the flexible jacket on installation is adjusted.

10. The method of claim 1, wherein the flexible jacket is comprised of at least one of cotton material, fluoropolymer material, a film material, a film material having glass beads adhered to it, or a film material having ceramic beads adhered to it.

11. The method of claim 1, wherein the adjustment tool comprises a colored end, wherein the colored end is one of white, yellow, orange, red, green, or a bright contrasting color that contrasts with the press and the flexible jacket.

12. The method of claim 1, wherein the adjustment tool has a tag on at least one end of the adjustment tool.

13. The method of claim 1, wherein first adjustment tool comprises a cord or a rope.

14. The method of claim 1, wherein the adjustment tool comprises at least one strip of hook and loop material.

15. The method of claim 14, wherein the adjustment tool comprises a plurality of strips of hook and loop material, each strip excepting a first strip coupled to at least one other strip along a hook side of the strip.

16. The method of claim 1, wherein the adjustment tool has an L-shaped cross-section.

17. The method of claim 1, wherein at least two faces of the adjustment tool have different color.

18. The method of claim 1, wherein the adjustment tool has a U-shaped cross-section, and wherein different segments of the cross-section having different lengths.

19. The method of claim 1, further comprising bending the adjustment tool away from the printing press when withdrawing the adjustment tool from between the transfer cylinder and the flexible jacket.

20. The method of claim 1, wherein the adjustment tool comprises a plurality of beads strung together.

* * * * *